US005933915A

United States Patent [19]

El Dessouky et al.

[11] Patent Number: 5,933,915

[45] Date of Patent: Aug. 10, 1999

[54] UNIVERSAL SLIP-ON DOOR STOPPER

[75] Inventors: Ahmed El Dessouky, 4086 Rosemead Blvd., Pico Rivera, Calif. 90660; Amani El Dessouky, Pico Rivera, Calif.

[73] Assignee: Ahmed El Dessouky, Pico Rivera, Calif.

[21] Appl. No.: 08/961,923

[22] Filed: Oct. 31, 1997

[51] Int. Cl.[6] ..... E05F 5/02

[52] U.S. Cl. ..... 16/82; 16/86 A; 16/121

[58] Field of Search ..... 16/82, 85, 86 A, 16/86 R, 86 B, 121, 118

[56] References Cited

U.S. PATENT DOCUMENTS

| | | | |
|---|---|---|---|
| 329,321 | 10/1885 | Leger et al. | 16/86 A |
| 2,125,783 | 8/1938 | Heeman | 16/86 A |
| 2,131,067 | 9/1938 | Paden | 16/86 A |
| 2,247,592 | 7/1941 | Swift | 16/86 A |
| 2,660,751 | 12/1953 | Falkenberg | 16/86 A |
| 2,699,809 | 1/1955 | Nebe et al. | 16/86 A |
| 2,721,597 | 10/1955 | Pitrella | 16/86 R |
| 2,731,056 | 1/1956 | Anson | 16/121 |
| 3,306,643 | 2/1967 | Reed | 16/121 |
| 4,223,931 | 9/1980 | Neary | 16/121 |
| 5,701,635 | 12/1997 | Hawkes | 16/86 A |

*Primary Examiner*—Chuck Y. Mah

*Attorney, Agent, or Firm*—Knobbe, Martens, Olson & Bear; Craig S. Summers

[57] ABSTRACT

A door stopper that is mounted directly to a door knob or a door handle of a door is disclosed. The door stopper is preferably made as a single piece from an elastomeric material so that it can easily slip over and substantially conform to the shape of various types of door knobs and door handles. The door stopper comprises a sleeve that fits over the door knob and a cushion extending outwardly from the door knob to cushion the impact of the door knob against a wall or other surface. Alternatively, a pair of inwardly tapered fingers may be used instead of a sleeve to secure the door stopper to a door handle.

10 Claims, 16 Drawing Sheets

UNIVERSAL SLIP-ON DOOR STOPPER

BACKGROUND OF THE INVENTION

The present invention relates to door stoppers that prevent damage to a wall by impact of a door knob and, more particularly, to a door stopper that fits on a door knob or door handle to prevent damage to the wall.

It is well known that the opening of a door may bring the door knob or door handle into contact with a wall or other surface to which the door is mounted. If the door swings against the wall with sufficient force, damage to the wall may result from the impact of the door knob or door handle. Over the years, several types of door stoppers have been developed to prevent damage to the wall by impact of the door knob or door handle.

With references to FIG. 1, a door 12 is shown mounted on a door frame by hinges in a conventional manner. The door 12 includes a door knob 10 for opening and closing the door, which swings towards a wall 24 when opened. FIG. 1 illustrates three conventional types of prior art door stoppers designed to prevent damage to the wall 24 by impact from the door knob 10.

One type of door stopper 4 is mounted on the wall 24 in alignment with the door knob 10 to prevent damage to the wall when the door swings open. Typically, the door stopper 4 is made of an elastomeric material which will absorb the impact. A second type of door stopper 6, also mounted on the wall 24, comprises in a elongated member having an outer portion which contacts the surface of the door 12 before he door knob 10 can contact the wall 24. In this type of door stopper 6, the outer portion of the door stopper that contacts the door 12 is usually made of an elastomeric material for absorbing the impact. Yet another type of door stopper 8 is mounted on the floor and typically has a vertical surface made of an elastomeric material for contacting the surface of the door 12 before the door knob 10 can contact the wall 24.

While the prior art door stoppers are generally useful for their intended purpose, they are not without their disadvantages. For example, the installation of a door stopper on a wall typically creates a weak point in the wall, and repeated impact of the door knob against the door stopper can loosen or dislodge the door stopper, resulting in damage to the wall. Moreover, many of the walls today are of a dry wall construction. As a result, special installation screws are required. This makes the door stopper more difficult to install. Replacing the door stopper after the wall mounting area has been damaged also can be especially difficult.

In the second type of wall-mounted door stopper 6 referred to above, the elongated member projects away from the wall, usually just above the floor, which makes it vulnerable to being stepped on, or having objects placed upon it, which can dislodge it from its mounted position. This requires repositioning or replacement of the door stopper, and creates the potential for wall damage while the door stopper is out of position.

In the floor-mounted type of door stopper 8, installation by a screw or other fastener is usually required, which a pilot hole is typically drilled in the floor. In tile floors, for example, the pilot hole, and/or the mounting screw received in that hole, can propagate cracks throughout the tile floor.

In all of the door stoppers described above, unsightly marks are left behind when the door stopper is removed and replaced with another type or the same type. Wall or floor repair is necessary to return the mounting surface to its original condition. Special installation tools and tedious measurements also may be required for these and other types of door stoppers. All of the prior art door stopper constructions consist of more than one component, require tools for installation, and introduce unknown elements in terms of the time and difficulty required for installation. These installation problems are especially magnified when the mounting area is tiled, carpeted, or papered.

Accordingly, there has existed a definite need for a door stopper that is simple to use easy to install and relatively inexpensive, and which does not require any floor or wall attachments or special installation tools. The present invention satisfies these and other needs, and provides further related advantages.

SUMMARY OF THE INVENTION

The present invention provides a new type of door stopper that is mounted directly to a door knob or a door handle of a door. The door stopper is preferably made as a single piece from an elastomeric material so that it can easily slip over and mount directly to different sizes and shapes of door knobs and door handles. No tools or special installation procedures are required, nor are any floor or wall attachments.

In one embodiment of the invention, the door stopper comprises a sleeve designed to slip over and substantially conform to the shape of the door knob, and a cushion extending outwardly from the door knob to cushion the impact of the door knob against a wall or other surface. The sleeve preferably comprises a relatively narrow neck at one end and an outwardly tapered section joined to the cushion at the other end of the sleeve. The sleeve has a relatively thin-walled construction to slip over and conform to the shape of the door knob, while the cushion has a relatively thicker-walled construction to provide the necessary degree of impact absorption.

In more detailed aspects of the first embodiment, the cushion has an inner surface with a configuration adapted to engage and retain the door stopper to the outer surface of various types of door knobs. These configurations on the inner surface of the cushion include a radius annular shoulder, a flat annular shoulder, and a tapered annular shoulder for engaging the outer surface configurations of the various door knobs. The cushion also may include a lock access hole for permitting access to a lock on the door knob. In this embodiment, the sleeve and the cushion each have a central axis that are in substantial alignment with each other.

In a second embodiment of the invention, the sleeve and the cushion each have a central axis at an angle to each other. This angle may be a ninety degree angle or such other angle as may be suitable for the shape of the door handle. This embodiment is particularly suited for use with door handles (rather than door knobs), that extend away from the door and that curve at an angle to the door's outer surface. Thus, the sleeve fits over and substantially conforms to the shape of the door handle that is parallel to the surface of the door, with the cushion extending outwardly from the door handle at an angle to the sleeve to cushion the impact of the door handle against a wall or other surface.

In a third embodiment of the invention, the door stopper comprises a substantially tubular cushion having an open side section, and a pair of inwardly tapered fingers projecting from the side section. The fingers engage a portion of the door handle extending away from the door surface, with the cushion extending outwardly from the door handle to cushion the impact of the door handle against a wall or other surface. The fingers may include inwardly projecting tabs at the end of each finger to permit the fingers to snap-fit over the door handle. In a more detailed aspect of this embodiment, the fingers are axially spaced apart from the cushion, and the cushion further includes a shoulder adjacent the open side section, such that the door handle extends out of the side section in abutting contact with the fingers and the shoulder.

Other features and advantages of the present invention will become apparent from the following description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Four typical prior art door knob constructions are shown in FIGS. 2*a*–2*d* and 3*a*–3*d*. Each of these door knobs 10 is connected to a door 12 by a mounting flange 14 and a generally cylindrical shaft 16. It will be noted that the configuration of the outer surface of each type of door knob is somewhat different. These four door knob configurations are examples of some of the many different types of existing door knobs and were selected to illustrate how the new door stopper of the present invention will fit door knobs having different sizes and shapes. However, it will be appreciated that the door stopper of the present invention can be used with many other different sizes and shapes of door knobs and that it would be impractical to show them all.

Figure 4A:
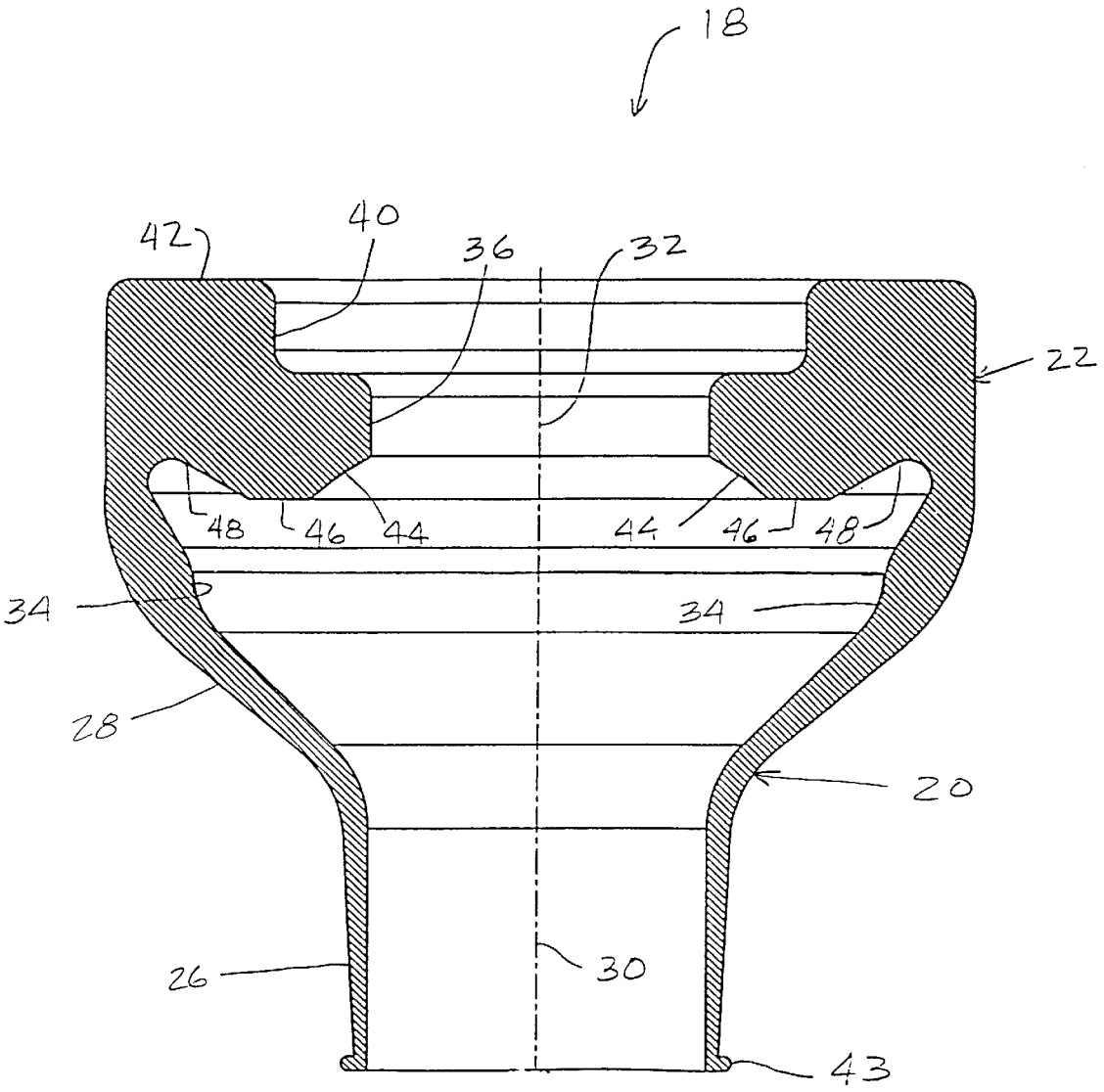
FIGS. 4*a*–4*c* are cross-sectional views of a first embodiment of a door stopper of the present invention.
Figure 4B:
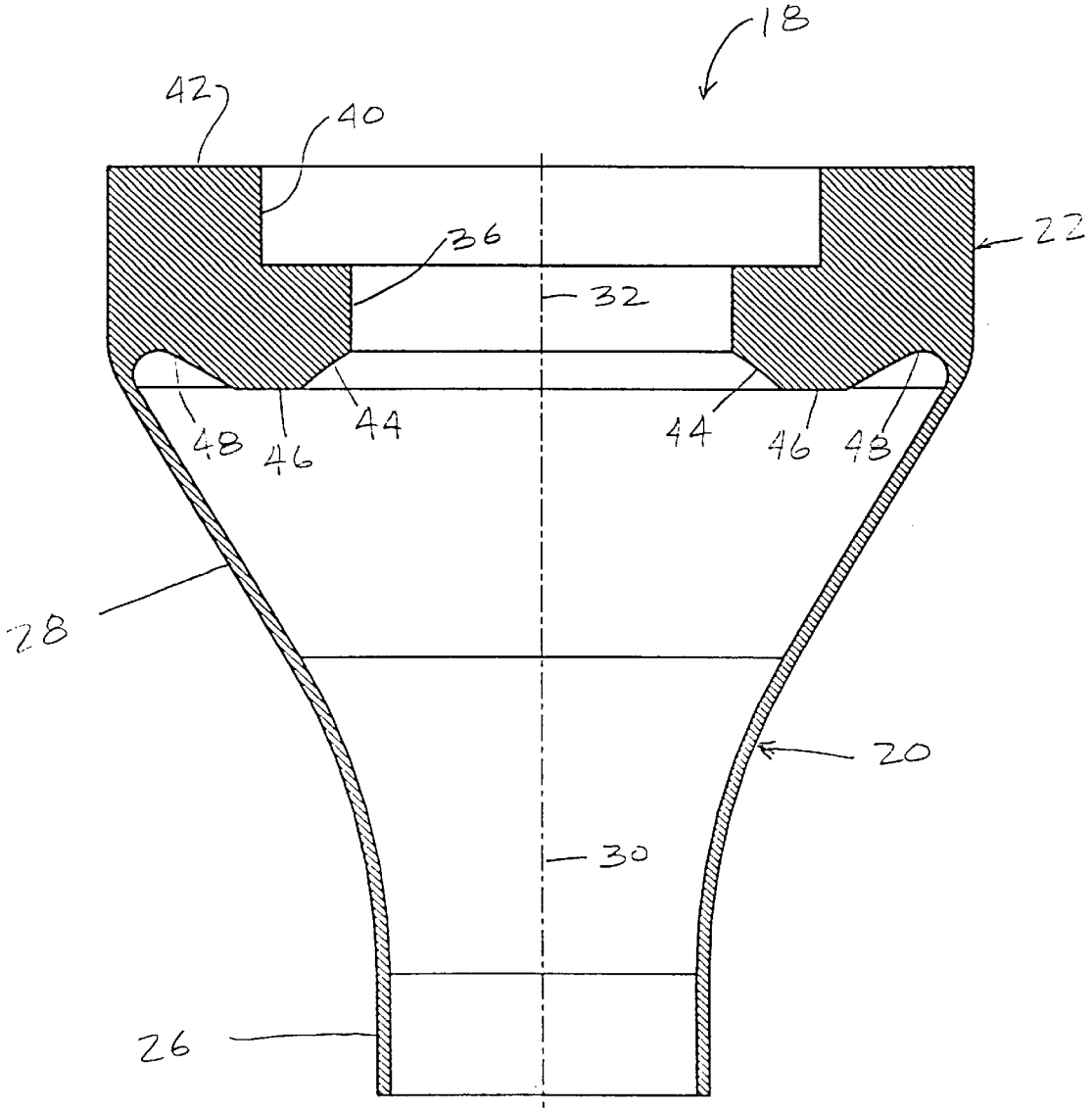
Figure 4C:
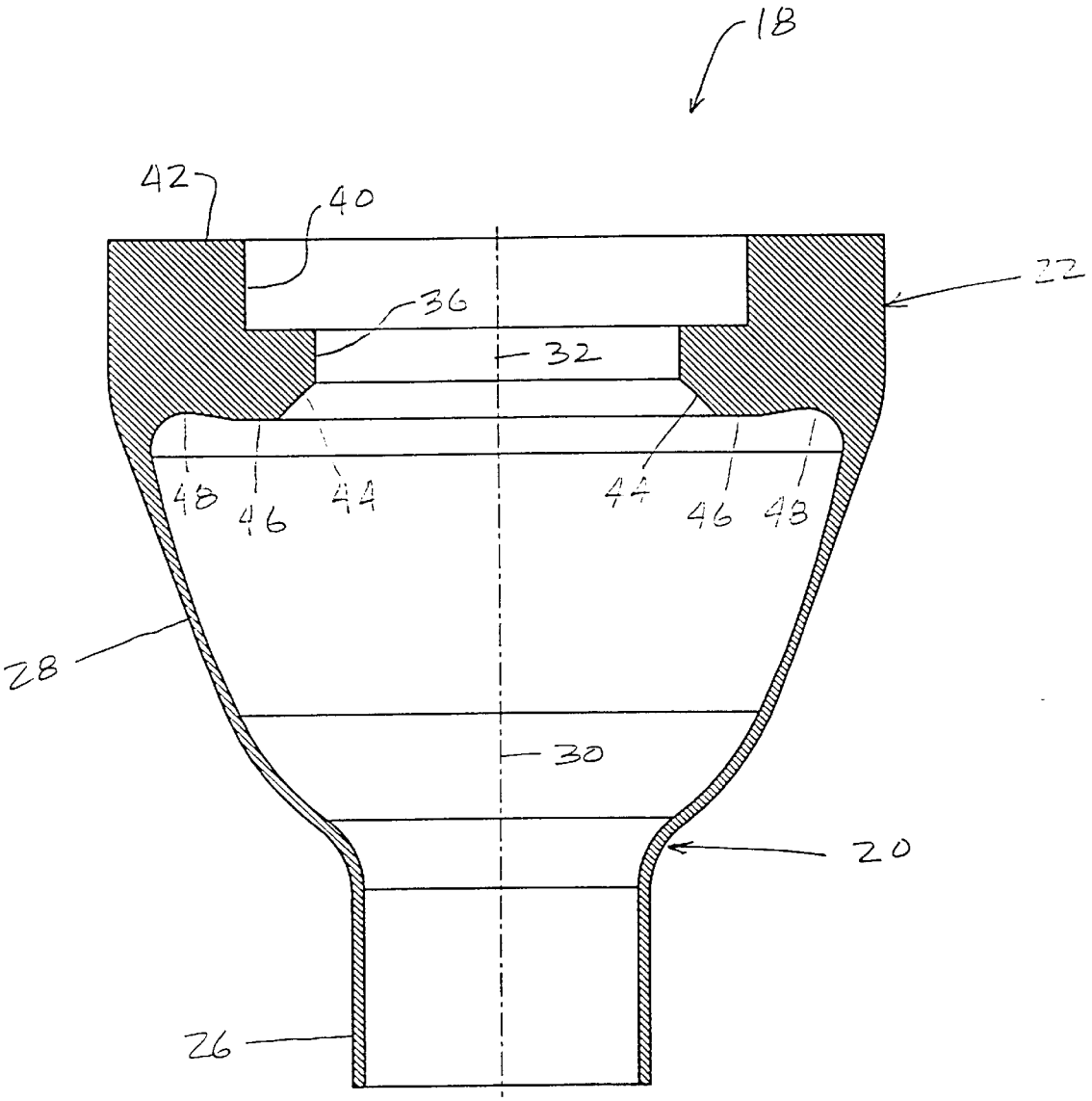

FIGS. 4*a*–4*c* are cross-sectional views of a first embodiment of a door stopper 18 of the present invention. This door stopper 18 is designed for use primarily in connection with the prior art door knob constructions of FIGS. 2*a*–2*d* and 3*a*–3*d*. As explained in more detail below, the door stopper 18 is designed to easily slip over and substantially conform to the shape of these and other similar types of door knobs 10.

Figure 1:
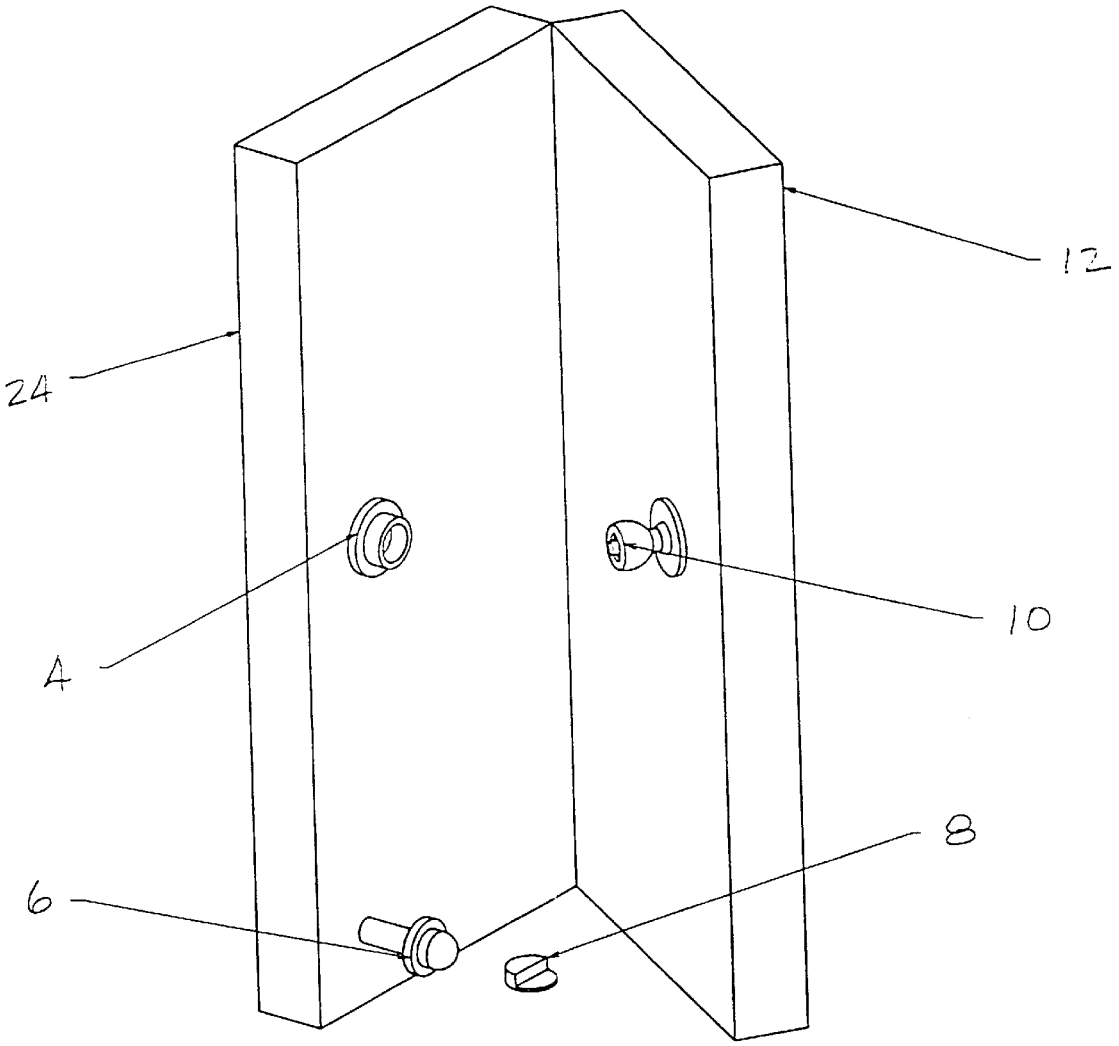
FIG. 1 (prior art)
FIG. 1 is a perspective view of a wall and a door with a door knob, showing several prior art door stopper constructions.
Figure 2A:
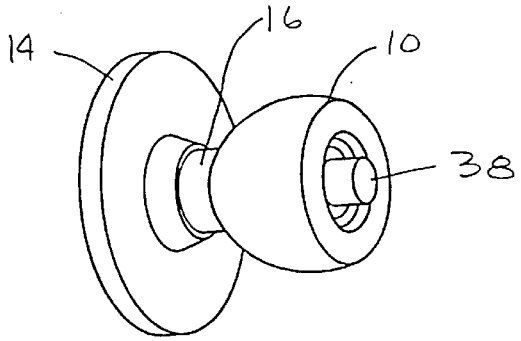
FIGS. 2*a*–2*d* are perspective views of several types of prior art door knob constructions.
Figure 2B:
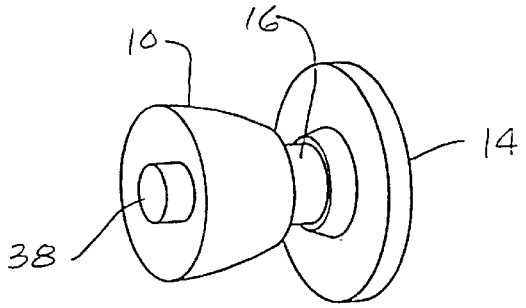
Figure 2C:
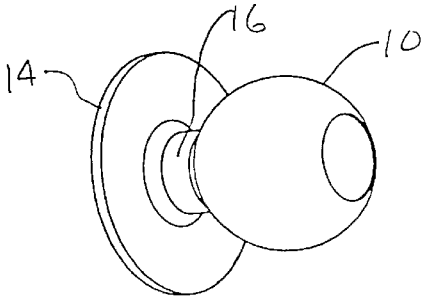
Figure 2D:
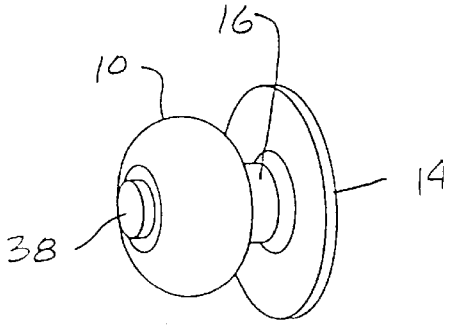
Figure 3A:
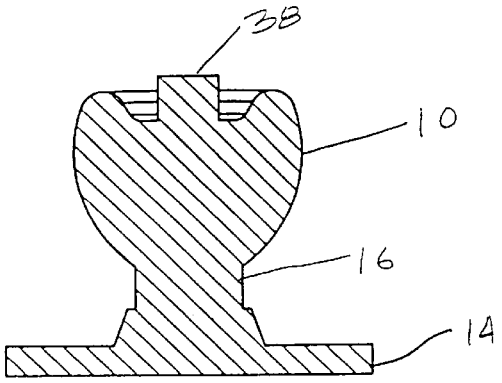
FIGS. 3*a*–3*d* are cross-sectional views of the prior art door knob constructions illustrated in FIGS. 2*a*–2*d;*
Figure 3B:
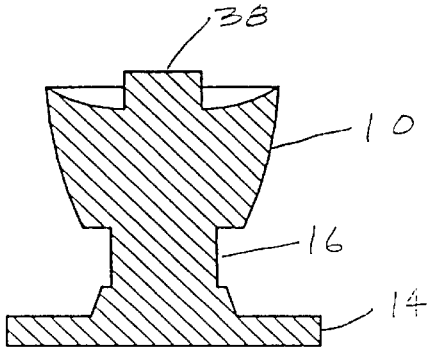
Figure 3C:
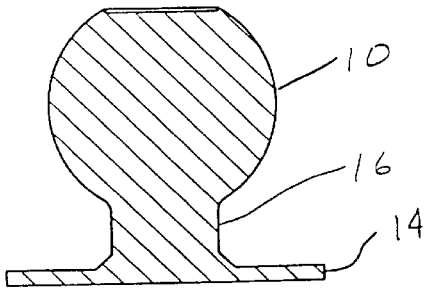
Figure 3D:
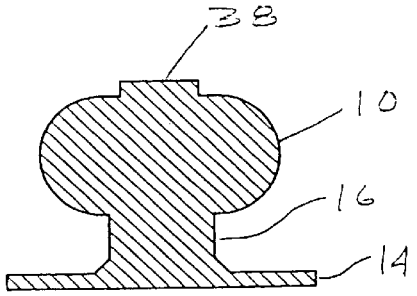

The door stopper 18 comprises a sleeve 20 and a cushion 22. Both the sleeve 20 and the cushion 22 preferably are formed as a single piece from an elastomeric material or other suitable rubber-like materials that can elastically stretch and conform to the shape of an object. In this way, the sleeve 20 is able to fit over and substantially conform to the shape of the door knob 10, with the cushion 22 extending outwardly from the door knob to cushion the impact of the door knob against a wall or other surface, such as the wall 24 illustrated in FIG. 1.

More particularly, the sleeve 20 comprises a relatively narrow neck 26 at one end and an outwardly tapered section 28 joined to the cushion 22 at the other end. Both the sleeve 20 and the cushion 22 have a central axis 30 and 32, respectively, which are in substantial alignment with each other. The sleeve 20 has a relatively thin-walled construction, whereas the cushion 22 has a relatively thicker-walled construction. In general, the thickness of the sleeve 20 should be small enough to permit the sleeve to stretch around and substantially conform to the shape of the door knob 10, but not so small as to permit tearing. Preferably, it is thin enough so as to not substantially increase the grip diameter of the door knob 10.

Thus, in one form of the invention, the thickness of the sleeve 20 preferably is between approximately 0.02–0.06 inches, but it is not limited to thicknesses within this range. The neck diameter should be sized so that it is narrow enough to prevent the door stopper 18 from being easily pulled off the door knob 10. The tapered section 28 is tapered so that the sleeve 20 does not have to stretch over its entire length to the maximum stretch point when fitting over the widest portion of the door knob 10. Thus, the sleeve 20 can be designed so that only the neck 26 will have the maximum stretch when it fits over the door knob. The configuration of the tapered section 28 can vary as desired, and several examples are shown in FIGS. 4*a*–4*c*.

The cushion 22 may include a lock access hole 36 to permit access to a lock 38 on the door knob 10. In addition, a counterbore 40 in the lock access hole 36 may be provided, forming an outer rim 42 for contact with the wall 24. The outer rim 42 increases the cushioning effect and the counterbore 40 facilitates access to the lock 38, which may be a push-button lock, a twist lock, a key lock or the like. As mentioned previously, the sleeve 20 can have a constant thickness, preferably between about 0.02–0.06 inches. However, in another aspect of the invention, the sleeve 20 can vary in thickness, with the sleeve wall being thinner at the neck 26 and progressively thicker as the tapered section 28 extends toward the cushion 22. A sleeve 20 with a variable wall thickness in the region of the tapered section 28 preferably will have the sleeve wall as thick as possible where the stretch is at a minimum and as thin possible where the stretch is at a maximum. With this design, shown in FIGS. 4*a* and 4*f*, the effort needed to stretch the sleeve 20 and slip it over the door knob 10 will be reduced. This design will also make the door stopper as strong as possible to prevent tearing. In addition, a small bead 43 around the outer edge of the neck 26 can further help prevent the sleeve 20 from tearing, as well as providing a smooth radius at the end of the neck.

Figure 4D:
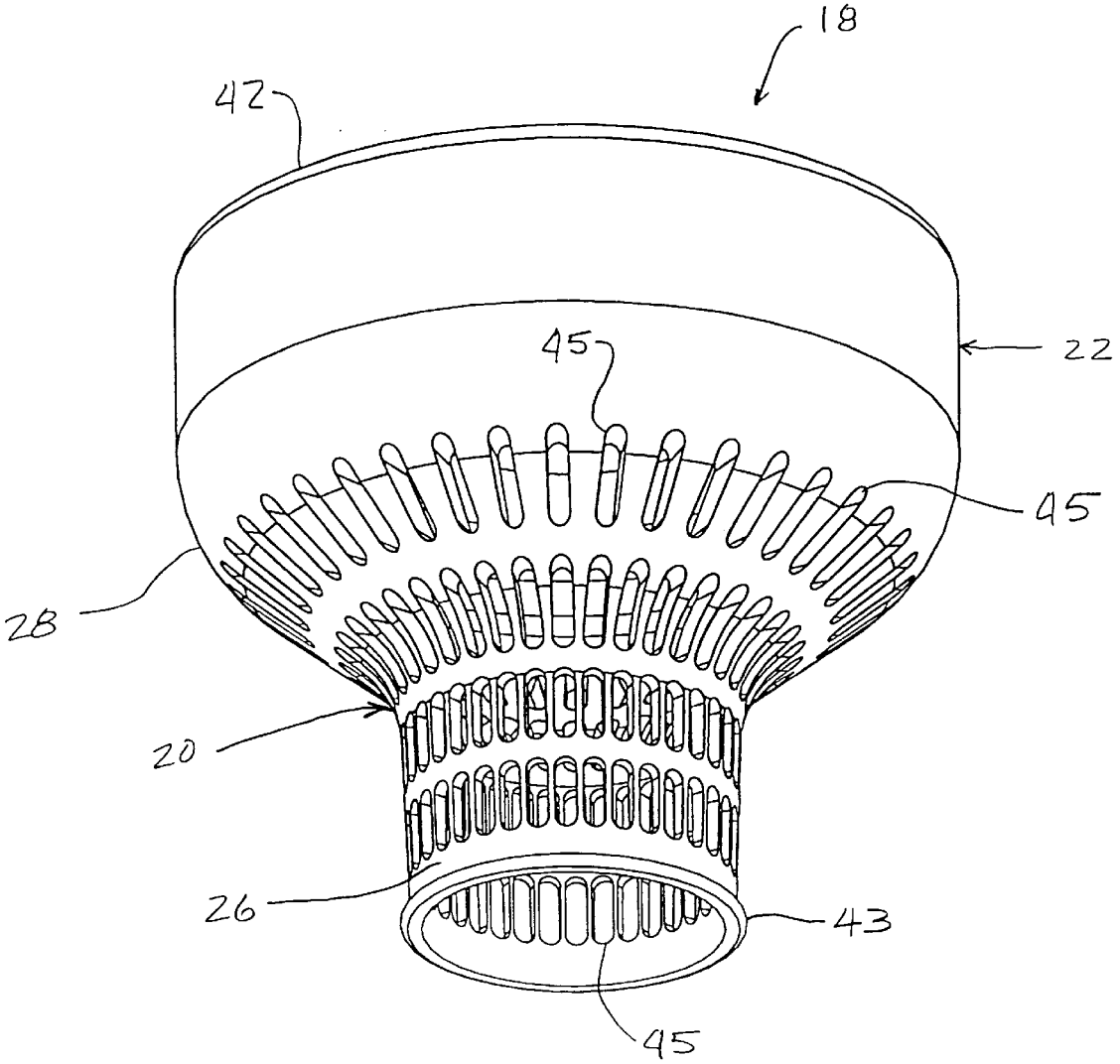
FIGS. 4*d*–4*f* are perspective views of variations of the first embodiment of the door stopper.
Figure 4E:
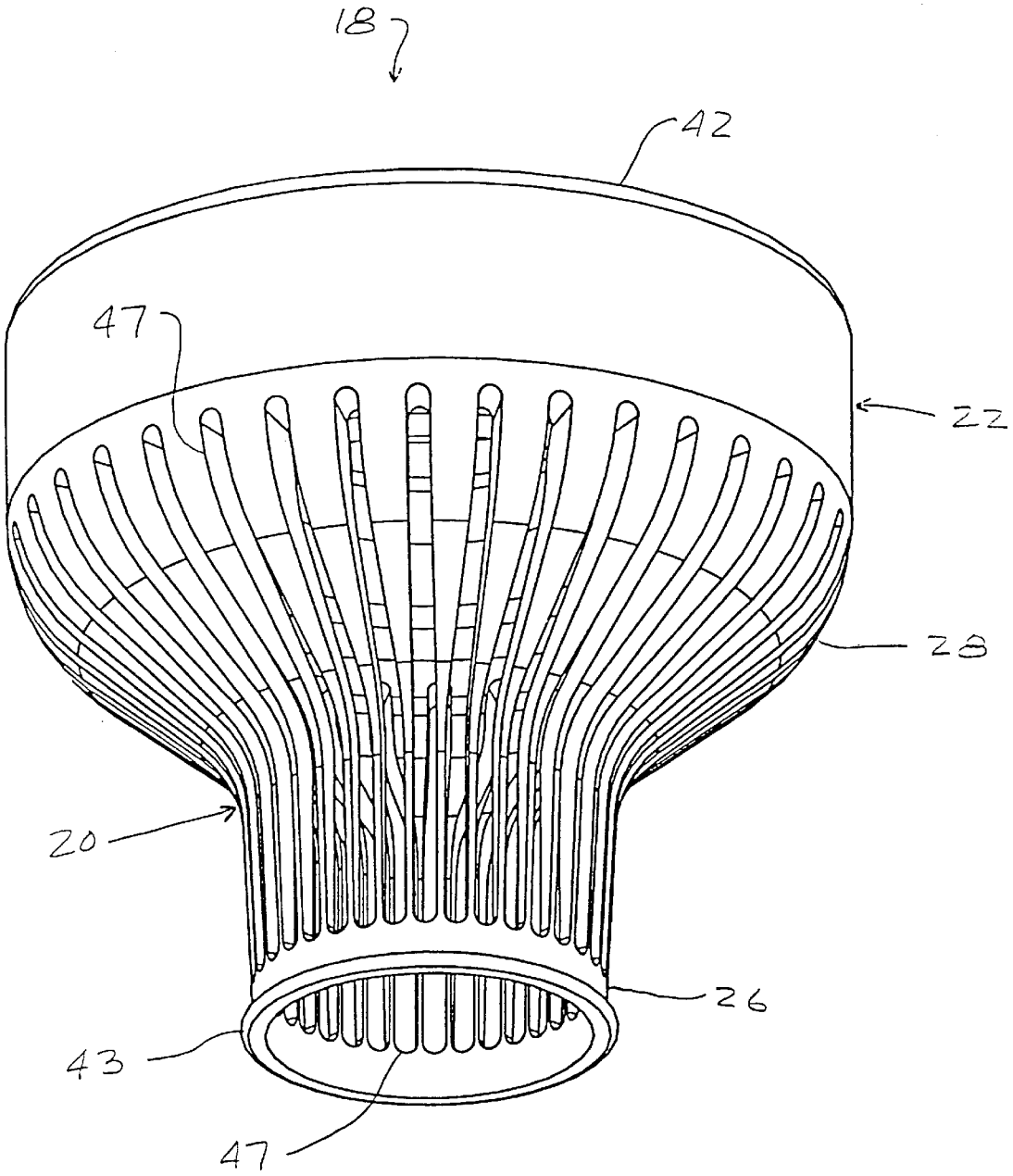
Figure 4F:
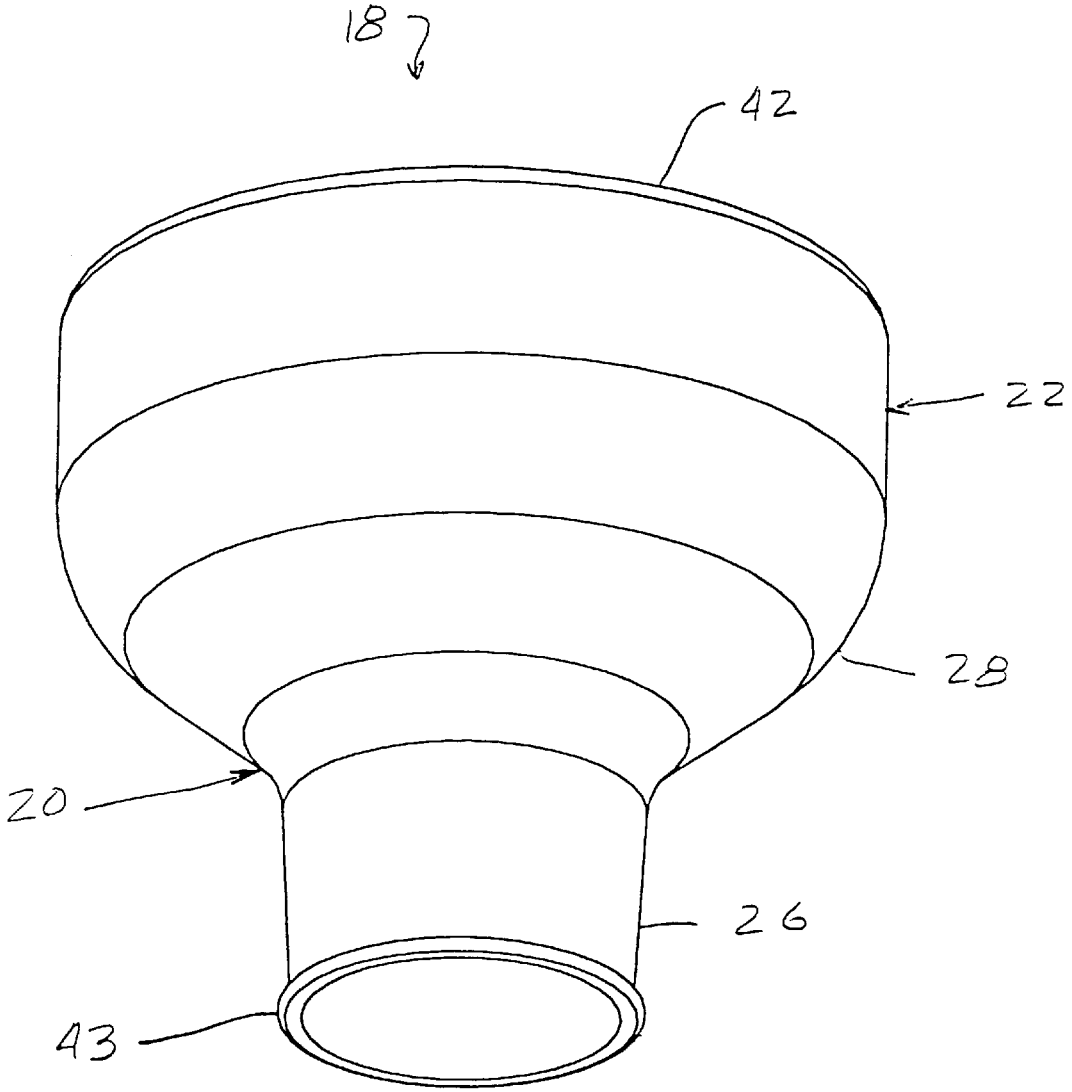

For added flexibility, if needed, the sleeve 20 may also have a series of holes or slots 45, as shown in FIG. 4*d*, or it may have slots 47 axially along its length, as shown in FIG. 4*e*, forming in effect a kind of elastomeric net or series of wires extending between the cushion 22 and the neck 26. With this combination of the net or wire and the tapered section 28 with the tapered wall thickness, the benefits of maximum wall thickness with maximum flexibility for stretch can be provided.

The inner surface of the cushion 22 has a configuration adapted to engage the outer surface of each of the prior art door knob constructions illustrated in FIGS. 2*a*–2*d* and FIGS. 3*a*–3*d*, as well as other types. In each of the door stoppers 18 illustrated in FIGS. 4*a*–4*c*, the inner surface of the cushion 22 has a radius annular shoulder 44 adjacent to the lock access hole 36, a flat annular shoulder 46 located radially outwardly from the radius shoulder 44, and a tapered annular shoulder 48 located radially outwardly from the flat annular shoulder 46. Each of these configurations is designed to engage the outer surface of one or more of the various prior art door knob constructions. Thus, as shown in FIGS. 5*a*–5*d*, the flat annular shoulder 46 is designed to engage the outer surface of the door knobs 10 of the type shown in FIGS. 5*a* and 5*d*, the tapered annular shoulder 48 is designed to engage the outer surface of the door knob 10 of the type shown in FIG. 5*b*, and the radius annular shoulder 44 is designed to engage the outer surface of the door knob 10 of the type shown in FIG. 5*c*. This engagement also provides support to keep the door stopper 18 in position when it impacts the wall 24.

In another aspect of the invention, the inner surface of the sleeve 20 may be roughened to enhance the gripping action between the sleeve 20 and the door knob 10. Gripping and positioning of the door stopper 18 on the door knob 10 is also facilitated by one of the annular shoulders 44, 46 or 48 and vertical shoulder 34, which cooperatively engage the door knob, as shown in FIGS. 5*a*–5*d*.

Figure 5A:
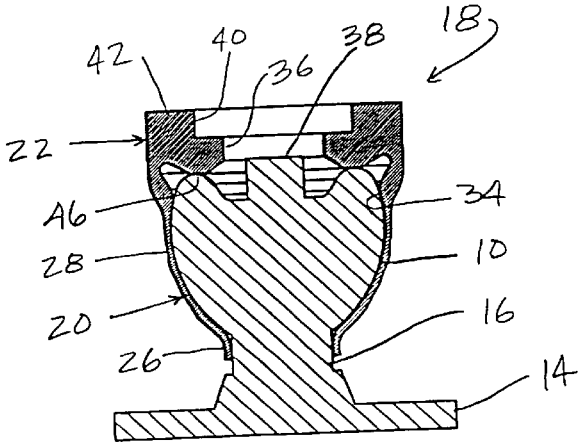
FIGS. 5*a*–5*g* are cross-sectional views of the door stopper and variations thereof mounted on the prior art door knob constructions.
Figure 5B:
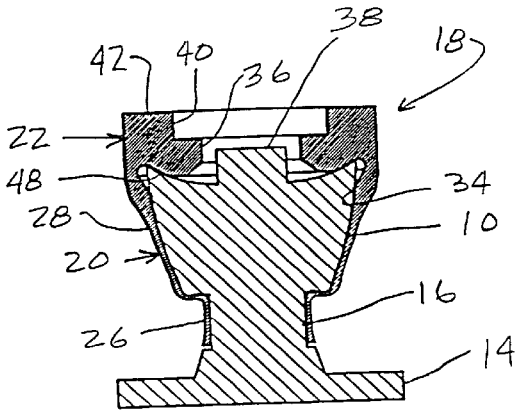
Figure 5C:
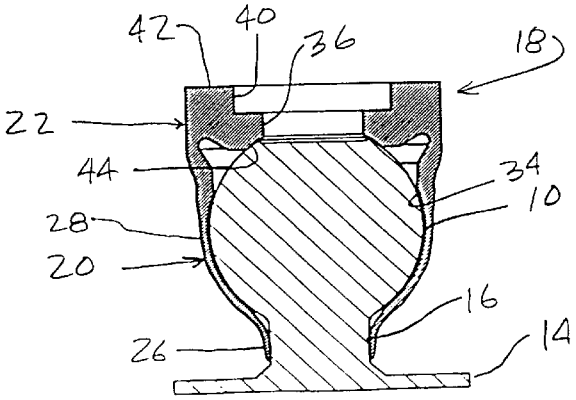
Figure 5D:
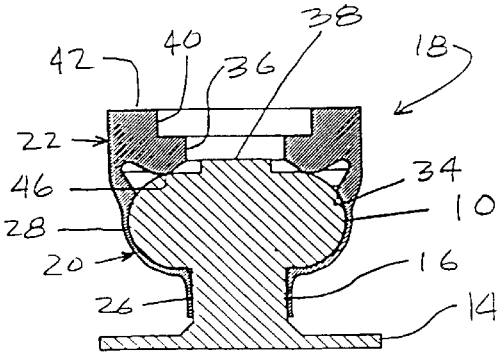
Figure 5E:
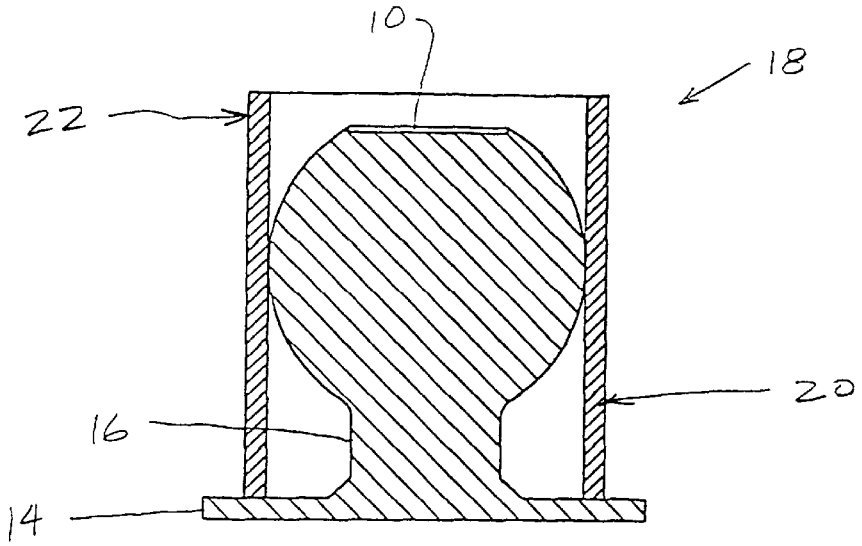
Figure 5F:
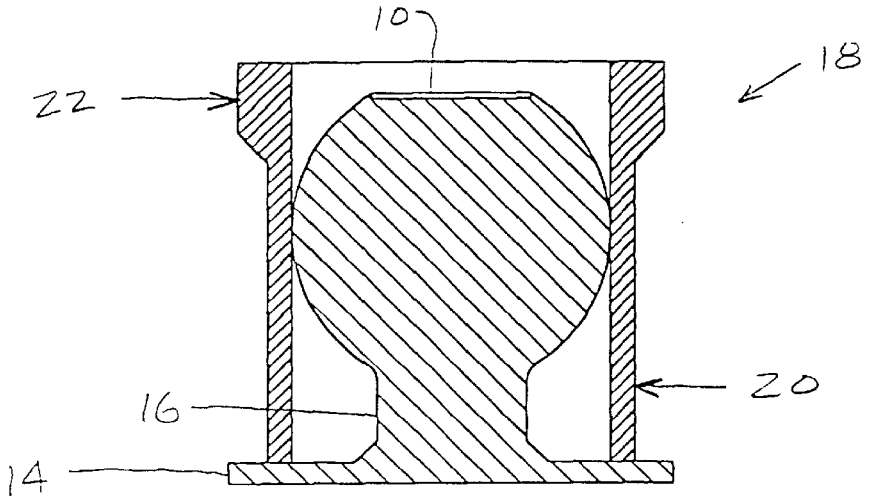
Figure 5G:
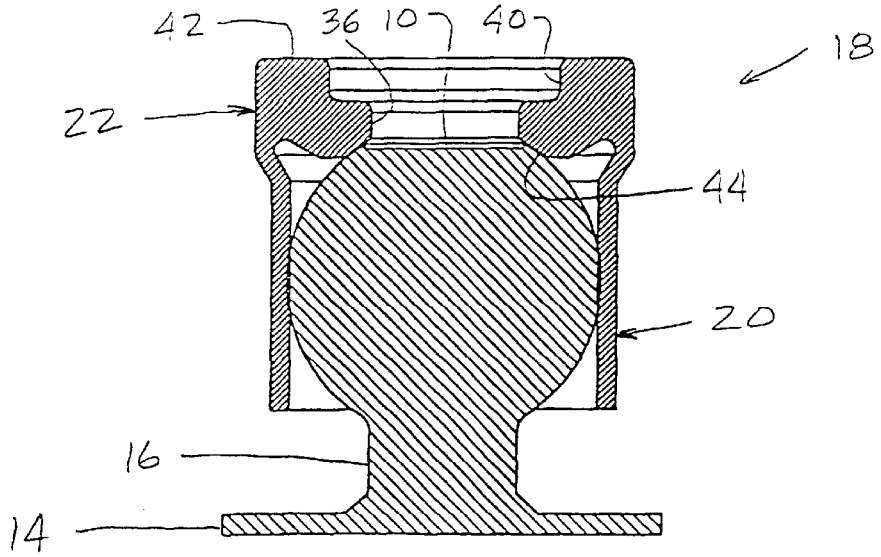

In other variations of the first embodiment of the invention, the door stopper 18 comprises a sleeve 20 in the form of a tube with a heavier wall thickness, in which the inside diameter of the sleeve is made small enough to be pressed-fitted over the door knob 10. In these variations, shown in FIGS. 5*e*–5*f*, one end of the sleeve will be situated against the flange 14 of the door knob 10 and the other end will protrude beyond the outer end of the door knob for contact with the wall and thereby prevent wall damage. The door stopper may have cushions 22 of different configurations, such as those shown in FIGS. 5*e*–5*g*.

The door stopper 18 can be manufactured in different colors and combinations of colors to provide a different cosmetic appearance suitable for the tastes of different consumers. In this regard, the door stopper in all of the embodiments disclosed herein can be manufactured by conventional injection molding techniques or by other suitable means.

Figure 6A:
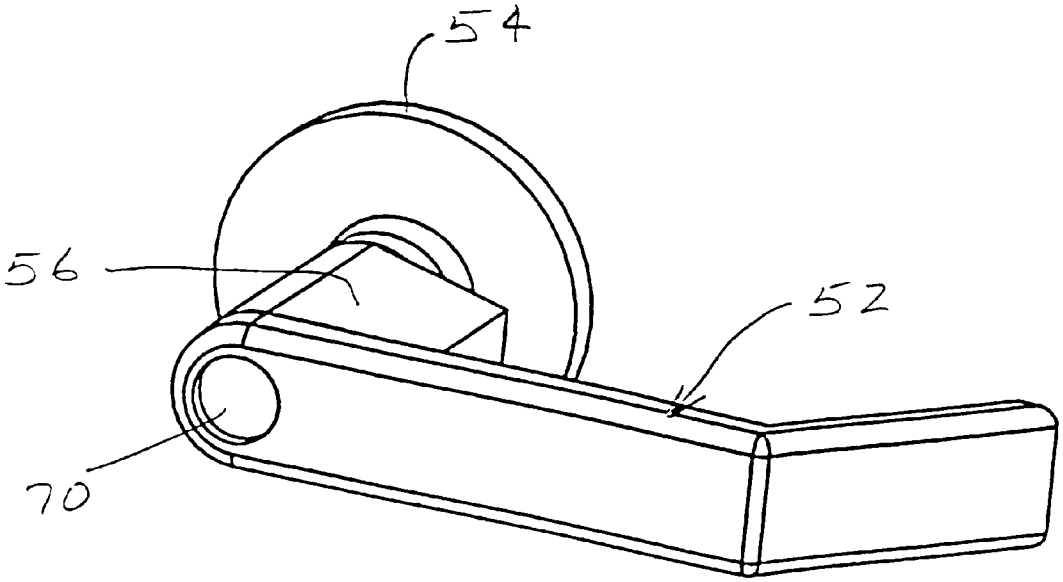
FIGS. 6*a*–6*b* are perspective views of one type of prior art door handle construction.
Figure 6B:
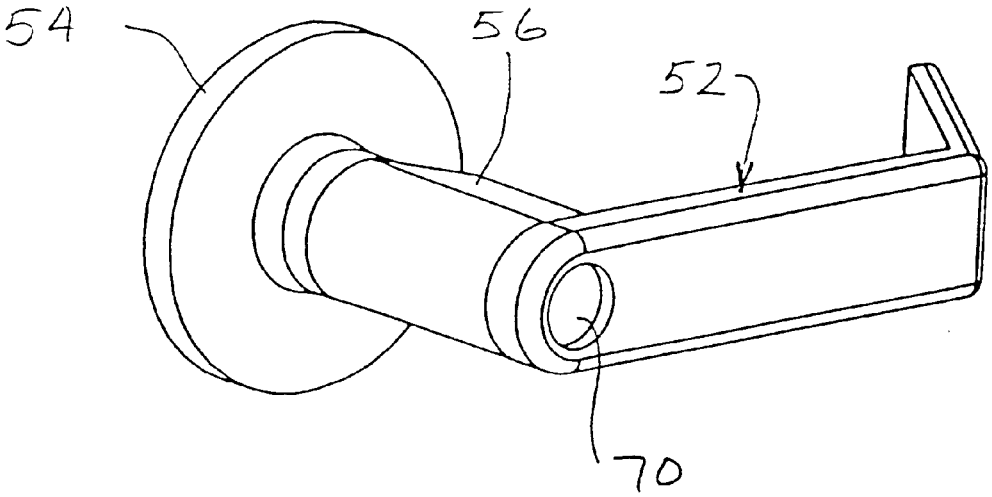
Figure 7A:
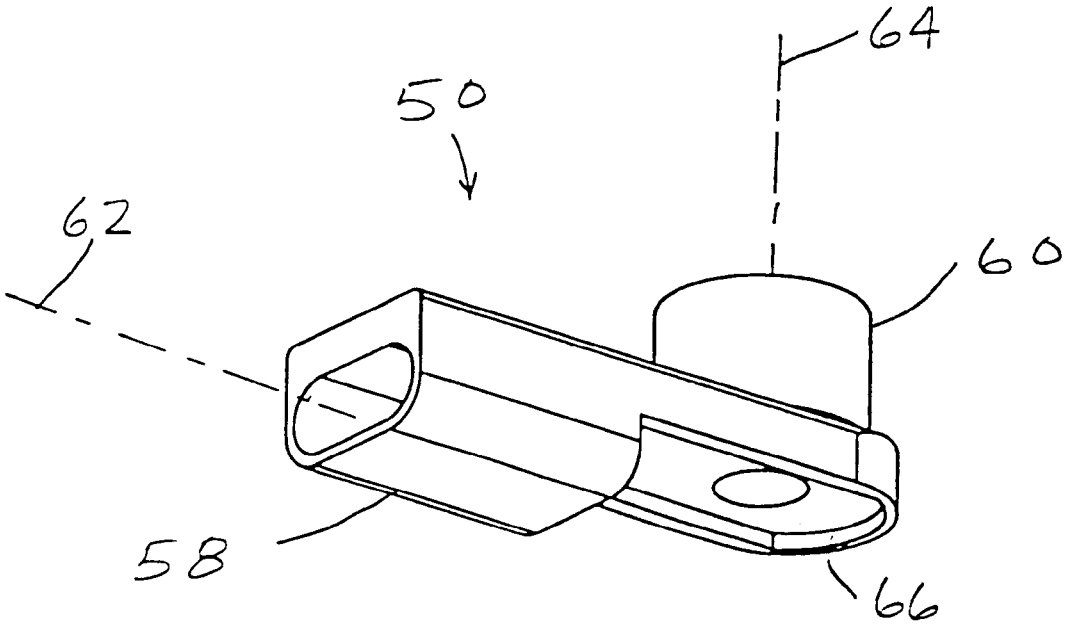
FIGS. 7*a*–7*b* are perspective views of a second embodiment of a door stopper of the present invention.
Figure 7B:
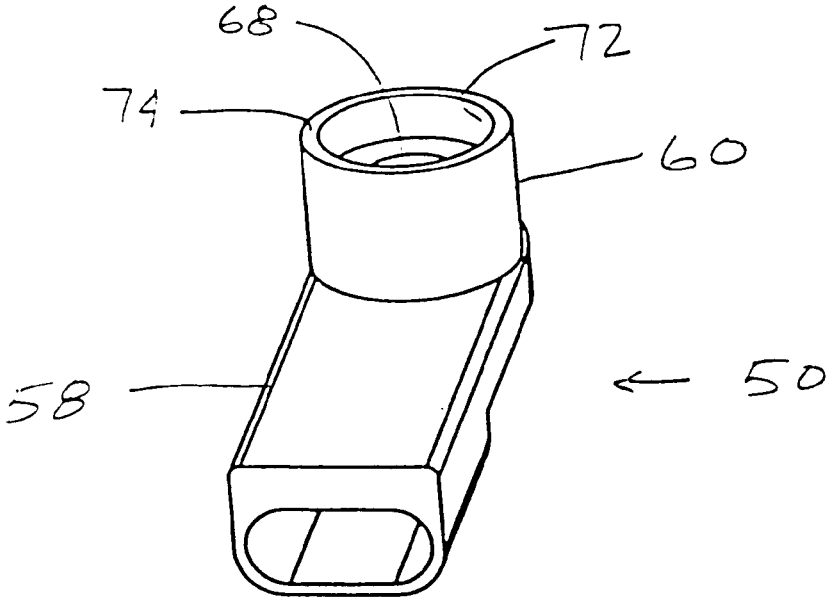

The second embodiment of a door stopper 50 of the present invention is designed for use with door handles 52 of the type shown in FIGS. 6*a*–6*b*. These types of door handles 52 typically extend parallel to the surface of the door 24, and are connected to the door by a mounting flange 54 and a cylindrical or other shaped shaft 56. In this embodiment, shown in FIGS. 7*a*–7*b*, the door stopper 50 also comprises a sleeve 58 and a cushion 60, with both the sleeve and the cushion preferably being formed as a single piece from an elastomeric material.

Figure 8A:
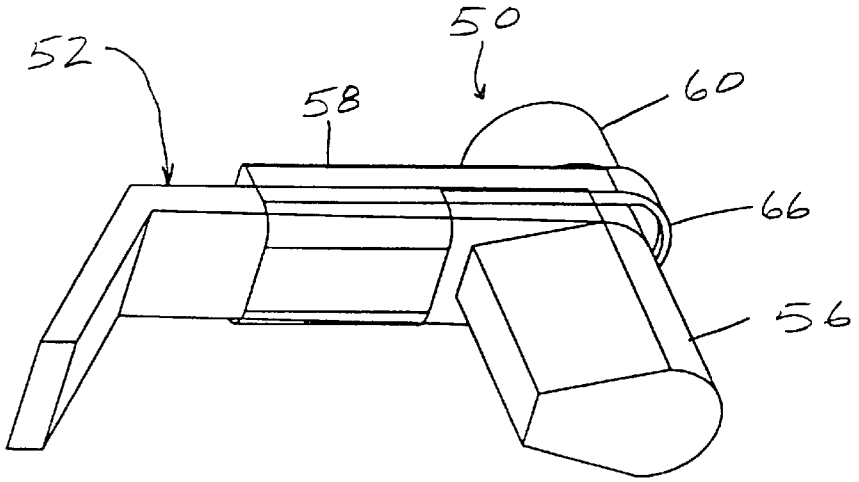
FIGS. 8*a*–8*b* are perspective views of the door stopper mounted on the prior art door handle construction.
Figure 8B:
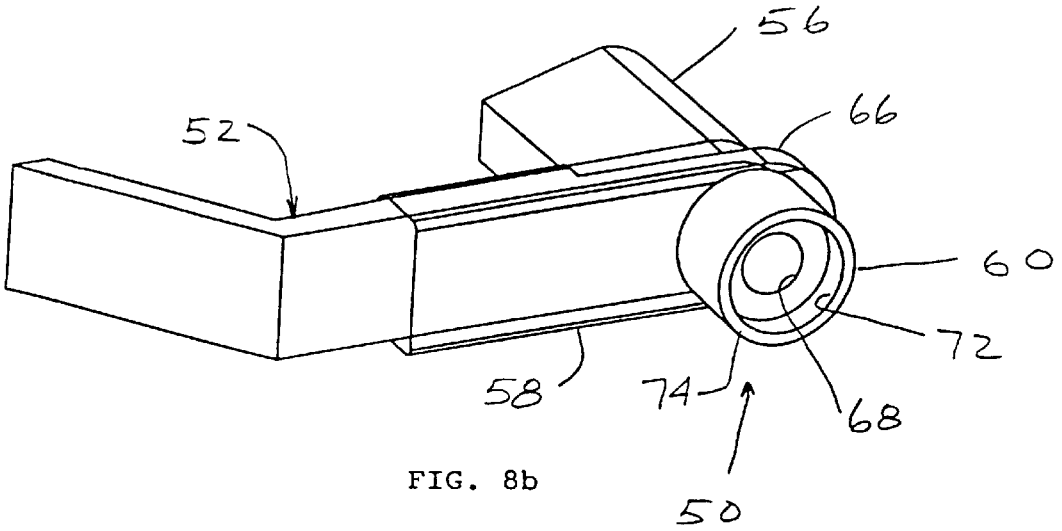

The sleeve 58 and the cushion 60 each have a central axis 62 and 64, respectively, at an angle to each other. The angle may be a ninety degree angle or such other angle as is suitable for the shape of the door handle 52. This allows the sleeve 58 to fit over and substantially conform to the shape of the door handle 52, with the cushion 60 extending outwardly from the door handle 52 to cushion the impact of the door handle against the wall 24, as shown in FIGS. 8*a*–8*b*. The cross-sectional shape of the sleeve 58 is made small and thin enough to stretch and conform to the shape of the door handle 52, whether it be cylindrical, rectangular, elliptical or some other shape.

The portion of the door stopper 50 where the sleeve 58 intersects the cushion 60 may include a lip 66 designed to receive and engage the door shaft 56. The lip 66 assists in positioning the door stopper 50 on the door handle 52 and preventing the door stopper from slipping off the door handle. The door stopper 50 also may have a lock access hole 68 to permit access to a lock 70, such as a push-button lock, a twist lock or a key lock. To facilitate access to such a lock 70, the cushion 60 also may be provided with a counterbore 72 to enlarge the area of access, and which forms an outer rim 74 to increase the cushioning effect.

The third embodiment of a door stopper 76 of the present invention also is designed for use with door handle constructions of the type shown in FIGS. 6*a*–6*b*. In this embodiment of the door stopper 76, shown in FIGS. 9*a*–9*d*, the door stopper comprises a substantially tubular cushion 78 having an open side section 80, and a pair of inwardly tapered fingers 82. These fingers 82 project from the side section 80 for engagement with the shaft 56 of the door handle 52, with the cushion 78 extending outwardly from the door handle to cushion the impact of the door handle against the wall 24. Like the first and second embodiments referred to above, the third embodiment of the door stopper 76 is also preferably formed as a single piece from an elastomeric material.

Figure 9A:
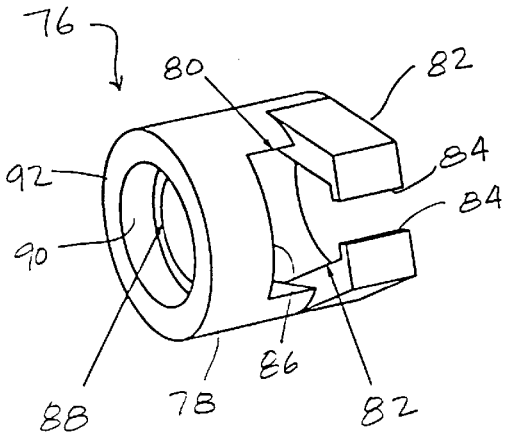
FIGS. 9*a*–9*d* include perspective and cross-sectional views of a third embodiment of a door stopper of the present invention.
Figure 9B:
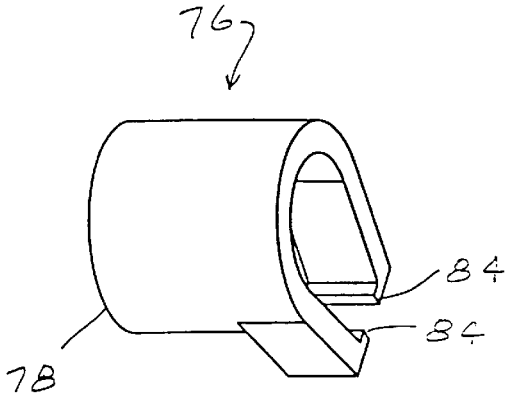
Figure 9C:
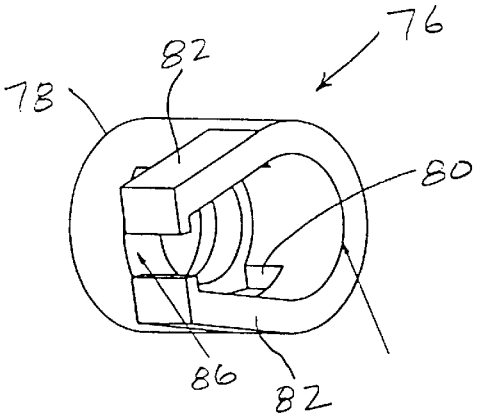
Figure 9D:
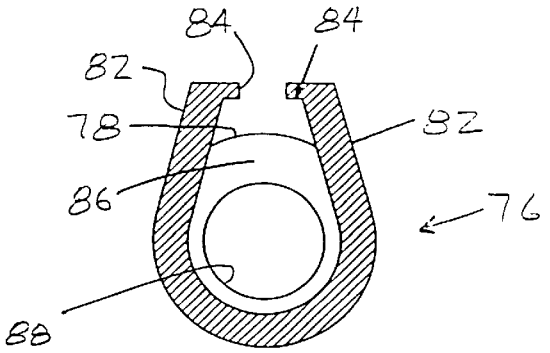
Figure 10A:
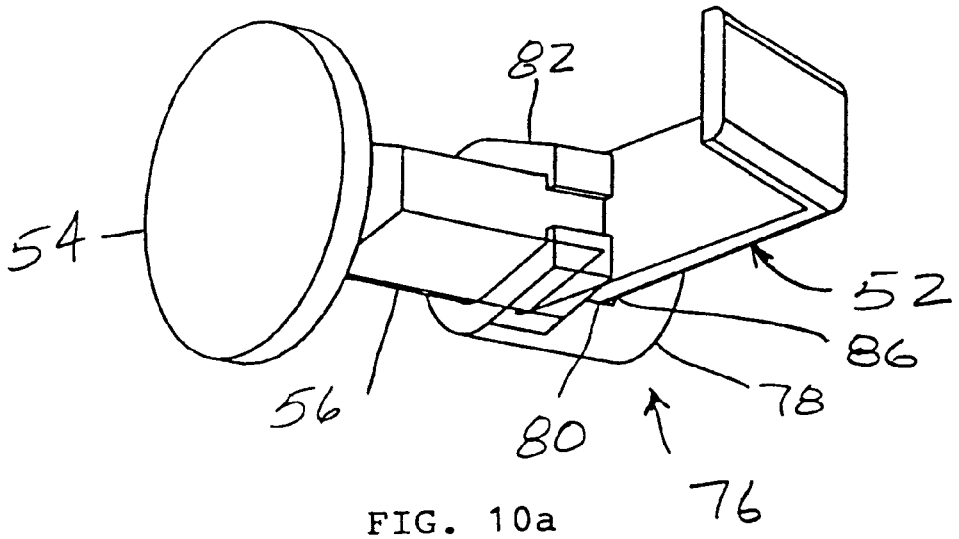
FIGS. 10*a*–10*b* are perspective views of the door stopper mounted on the prior art door handle construction.
Figure 10B:
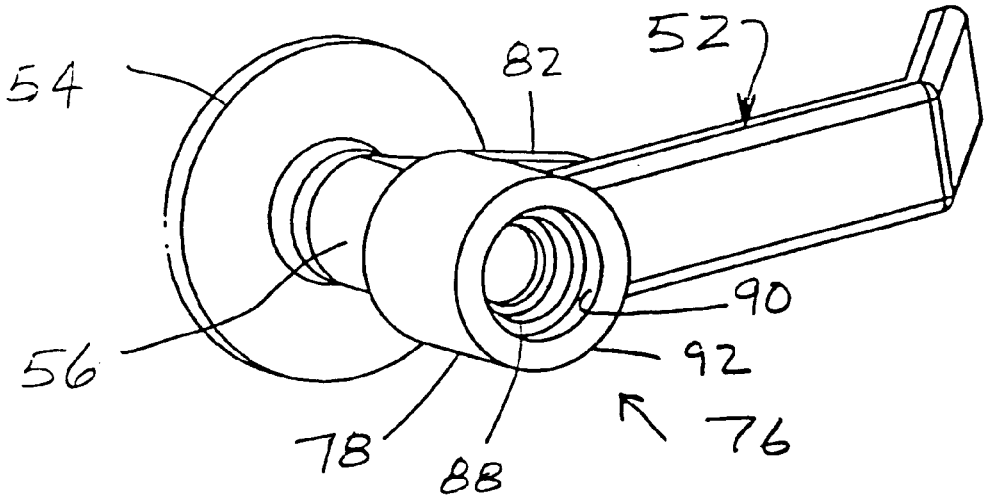

As shown in FIG. 9*d*, the fingers 82 have a generally horseshoe-shaped configuration to snap-fit over the shaft 56 of the door handle 52. Inwardly projecting tabs 84, one at the end of each finger 82, assist in permitting the fingers to snap-fit over and retain the door stopper 76 on the door handle 52. In this regard, reference is made to FIGS. 9*d* and 10*a*, showing these features. These figures also illustrate the door handle 52 extending out of the open side section 80 of the door stopper 76. The door handle 52 is able to extend through the side section 80 because the fingers 82 are axially spaced apart from the cushion 78. As a result of this axial spacing, the cushion 78 further includes a shoulder 86 where the cushion joins the side section 80. With this structure, the door handle 52 extends out of the side section 80 and is secured in abutting contact between the shoulder 86 and the fingers 82. This securely attaches the door stopper 76 to the door handle 52.

Like the other embodiments, the cushion 78 may have a lock access hole 88 to permit access to the door lock 70 on the door handle 52. A counterbore 90 also is provided to facilitate access to the lock 70, together with an outer rim 92 to increase the cushioning effect.

From the foregoing, it will be appreciated that the door stopper of the present invention can be readily and easily installed and replaced, without requiring any special installation tools or measurements, or any floor or wall attachments. As a result, expensive wall repair can be avoided. Moreover, the door stopper can have a dual function, in the sense that it can be manufactured in different colors or combinations of colors to provide a variety of cosmetic looks. Alternatively, it can be used as a decorative piece on the door handle or the door knob, for example, when the original color of the door knob or door handle has faded away. In these situations, it will be much less expensive to apply the door stopper rather than replace the door knob, and the protective function of the door stopper will also be provided.

It will also be appreciated that all of the door stoppers described above can be molded directly onto the door knob or door handle at the time the door knob or the door handle is manufactured, or at a later stage, so that the door stopper and the door knob or the door handle can be manufactured and sold as a single unit. Of course, the universal slip-on door stopper can be used on already-installed door knobs and door handles instead of the molded door stopper.

While a particular form of the invention has been illustrated and described, it will be apparent that various modifications can be made without departing from the spirit and scope of the invention.

What is claimed is:

1. A door stopper for attachment to a door knob, comprising:

a. a relatively thin-walled elastomeric sleeve adapted to be retained on the door knob;

b. a relatively thick-walled cushion connected to the sleeve, wherein the cushion is adapted to engage a wall or other surface when the door is opened;

c. a door lock access hole in the cushion;

d. a shoulder on the inner surface of the cushion adapted to engage the door knob; and e. a counterbore forming an outer rim on the cushion adapted to increase the cushioning effect of the door stopper and to improve accessibility to a lock of the door knob.

2. The door stopper of claim 1, wherein the sleeve is adapted to elastically stretch over and substantially conform to the shape of the door knob, and wherein the sleeve has at least one radial opening.

3. The door stopper of claim 1, wherein the sleeve is tapered.

4. A door stopper for attachment to a door knob, comprising:

a. a relatively thick-walled cushion adapted to engage a wall or other surface when the door is opened;

b. a relatively thin-walled, tapered elastomeric sleeve having a first end adapted to be slipped over the door knob and having a second end connected to the cushion, wherein the sleeve comprises a wall that increases in thickness from said first end, where the wall is relatively thin, to said second end, where said wall is relatively thick;

c. a door lock access hole in the cushion; and d. a shoulder on the inner surface of the cushion adapted to engage the door knob.

5. A universal door stopper for attachment to door knobs having different shapes, comprising:

a. an elastomeric sleeve adapted to elastically stretch over and substantially conform to the shapes of the door knobs; and b. a cushion connected to the sleeve, wherein the cushion has an outer surface adapted to engage a wall or other surface, and an inner surface with a plurality of annular shoulders adapted to engage said door knobs, wherein said shoulders comprise at least a radius annular shoulder and a flat annular shoulder.

6. The universal door stopper of claim 5, wherein the plurality of annular shoulders further includes a tapered annular shoulder.

7. The universal door stopper of claim 6, wherein the tapered annular shoulder is positioned radially outward from the other two annular shoulders.

8. The universal door stopper of claim 5, wherein the flat annular shoulder is positioned radially outward from the radius annular shoulder.

9. In combination, a door stopper and a door handle of the type having a shaft connected to a door and a handle connected to the shaft in a substantially perpendicular relationship relative to the shaft, the door stopper comprising:

a. a sleeve including a pair of fingers projecting radially outward from the sleeve and adapted to engage the shaft, wherein the sleeve has an axis that is substantially parallel to the shaft when the sleeve is mounted on the shaft; and b. a substantially tubular cushion connected to the sleeve, wherein the cushion is adapted to engage a wall or other surface when the door is opened, and wherein the cushion has an axis that is substantially coincident to the axis of the sleeve.

10. A door stopper for attachment to a door knob, comprising:

a. a relatively thick-walled cushion adapted to engage a wall or other surface when the door is opened;

b. a relatively thin-walled, tapered elastomeric sleeve connected to the cushion and adapted to be retained on the door knob, wherein the sleeve has an internal diameter that increases in a direction from a point opposite the cushion to a point where the sleeve is connected to the cushion, to thereby allow the door stopper to be attached to door knobs having different diameters;

c. a door lock access hole in the cushion; and d. a shoulder on the inner surface of the cushion adapted to engage the door knob.

* * * * *